US009903361B2

(12) United States Patent
Xiang

(10) Patent No.: US 9,903,361 B2
(45) Date of Patent: Feb. 27, 2018

(54) DERRICK-TYPE LONG-STROKE HYDRAULIC PUMPING UNIT

(71) Applicant: SHANGHAI LIANCHUANG INDUSTRIAL CO., LTD., Shanghai (CN)

(72) Inventor: Zhongxin Xiang, Haimen (CN)

(73) Assignee: SHANGHAI LIANCHUANG INDUSTRIAL CO., LTD., Shanghai (CN)

( * ) Notice: Subject to any disclaimer, the term of this patent is extended or adjusted under 35 U.S.C. 154(b) by 463 days.

(21) Appl. No.: 14/651,383

(22) PCT Filed: Nov. 29, 2012

(86) PCT No.: PCT/CN2012/001598
§ 371 (c)(1),
(2) Date: Jun. 11, 2015

(87) PCT Pub. No.: WO2014/067036
PCT Pub. Date: May 8, 2014

(65) Prior Publication Data

US 2015/0330384 A1 Nov. 19, 2015

(30) Foreign Application Priority Data

Oct. 30, 2012 (CN) ..... 2012 1 0421280

(51) Int. Cl.
*F04B 47/02* (2006.01)
*F04B 19/22* (2006.01)
*E21B 43/12* (2006.01)

(52) U.S. Cl.
CPC ..... *F04B 47/026* (2013.01); *E21B 43/126* (2013.01); *F04B 19/22* (2013.01)

(58) Field of Classification Search
CPC ..... B66F 11/004; B66F 7/02; F04B 47/026; F04B 19/22; B66B 7/08; E21B 43/162; E21B 43/121; E21B 43/127; E21B 43/125
See application file for complete search history.

(56) References Cited

U.S. PATENT DOCUMENTS 3,248,958 A * 5/1966 Bender ..... E21B 43/12 242/388.6
5,862,888 A * 1/1999 Iwakiri ..... B66B 7/08 187/292

(Continued)

FOREIGN PATENT DOCUMENTS

CN 1654781 A 8/2005
CN 101638980 A 2/2010

(Continued)

OTHER PUBLICATIONS

International Search Report and Written Opinion in PCT/CN2012/001598 dated Aug. 8, 2013.

*Primary Examiner* — Charles Freay
*Assistant Examiner* — Christopher Brunjes
(74) *Attorney, Agent, or Firm* — Leason Ellis LLP

(57) ABSTRACT

A derrick-type long-stroke hydraulic pumping unit containing a rack, a counterweight basket, a sucker rod side oil cylinder, a counterweight basket side oil cylinder, a hydraulic station, and an oxbow component. The sucker rod side oil cylinder and the counterweight basket side oil cylinder each include a cylinder barrier. A piston and a piston rod are disposed inside the cylinder barrel. A cylinder cap component includes a cylinder cap body. A pressing sleeve mechanism is disposed on an upper part of the cylinder cap body. An oil scraping mechanism is disposed between the cylinder cap body and the pressing sleeve mechanism. The hydraulic pumping unit has the advantages of a reasonable structure, (Continued)

a long service life, high work efficiency, and resource saving.

9 Claims, 9 Drawing Sheets

(56) References Cited

U.S. PATENT DOCUMENTS

| | | | | |
|---|---|---|---|---|
| 6,123,525 | A * | 9/2000 | Burns | F04B 11/0016 303/87 |
| 2007/0217912 | A1* | 9/2007 | Schmidt | F03D 7/0224 416/98 |
| 2008/0196523 | A1* | 8/2008 | Liu | F16H 25/2418 74/89.4 |
| 2009/0288913 | A1* | 11/2009 | Nielsen | A62B 1/06 182/8 |
| 2011/0006068 | A1* | 1/2011 | Kaupp | B65D 88/08 220/562 |
| 2011/0284238 | A1 | 11/2011 | Berry et al. | |
| 2012/0114510 | A1 | 5/2012 | Brown | |

FOREIGN PATENT DOCUMENTS

| | | | | |
|---|---|---|---|---|
| CN | 101718186 | A | 6/2010 | |
| CN | 102587868 | A | 7/2012 | |
| CN | 102704897 | A * | 10/2012 | |
| CN | 202900184 | U | 4/2013 | |
| WO | WO 2012010031 | A1 * | 1/2012 | F15B 15/222 |

* cited by examiner

DERRICK-TYPE LONG-STROKE HYDRAULIC PUMPING UNIT

BACKGROUND OF THE INVENTION

Field of the Invention

The present invention relates to a pumping unit, and in particular, to a derrick-type long-stroke hydraulic pumping unit.

Description of Related Art

A pumping unit is a machine device for oil extraction and is known as a "nodding machine", which pumps petroleum out of a well through pressurization. At present, a "triplex" (a sucker pump, a sucker rod, and a pumping unit) manner is commonly used for oil extraction in oil fields. In existing derrick-type long-stroke hydraulic pumping units, a rack of a hydraulic pumping unit is of an oblique ladder shape, which in one hand results in waste in materials, and in the other hand has low firmness, is inconvenient to maintain, and cannot satisfy use requirements. The existing hydraulic pumping unit has a complex hydraulic control system, which has high technical requirements for use and maintenance and cannot satisfy production and energy-saving requirements of an end user. The existing pumping unit has an oil cylinder structure having the disadvantages of a complex structure, low work efficiency, and poor sealing, and a shell of the cylinder is easily worn after the cylinder is used for a long time, thereby affecting its work efficiency and service life. Furthermore, when the hydraulic pumping unit is maintained, a counterweight basket or an oil cylinder needs to fall onto the ground or the lowest position, and after the maintenance is finished, the counterweight basket or the oil cylinder needs to be restored to its original position and provided with a load. However, the counterweight basket or the oil cylinder is very heavy so that it is very difficult to restore the counterweight basket or the oil cylinder to the original position. Therefore, there is a need for an improved technique to solve the problems in the prior art.

SUMMARY OF THE INVENTION

Technical Problem

In view of the above disadvantages, the objective of the present invention is to provide a derrick-type long-stroke hydraulic pumping unit with a reasonable structure, a long service life, high work efficiency, and resource saving.

Technical Solution

In order to achieve the above objective, the technical solution adopted in the present invention is as follows:

A derrick-type long-stroke hydraulic pumping unit, comprising: a rack, a counterweight basket, a sucker rod side oil cylinder, a counterweight basket side oil cylinder, a hydraulic station, and an oxbow component for fixing a steel wire rope, where six groups of fixed pulleys and a guard bar are disposed on the top of the rack, movable pulleys are disposed at the bottom of each of the sucker rod side oil cylinder and the counterweight basket side oil cylinder, a steel wire rope fixing mechanism is disposed on the counterweight basket, and the counterweight basket is connected to the fixed pulleys, the movable pulleys and the oxbow component through the steel wire rope, wherein each of the sucker rod side oil cylinder and the counterweight basket side oil cylinder includes a cylinder barrel component, the cylinder barrel components each includes a cylinder barrel, a cylinder head is disposed at one end of the cylinder barrel, a cylinder cap component is disposed at the other end of the cylinder barrel, a cylinder shell is disposed outside the cylinder barrel and is a double layered cylinder shell, a piston and a piston rod are disposed inside the cylinder barrel, multiple annual oil grooves are formed on the piston rod, the cylinder cap component includes a cylinder cap body, a pressing sleeve mechanism is disposed on an upper part of the cylinder cap body and is fixedly connected to the cylinder cap body through a fixing member, the cylinder cap body includes an inner barrel body and an outer barrel body, two ends of the inner barrel body and the outer barrel body are connected through an annular plate, a drain port is disposed on the inner barrel body, the pressing sleeve mechanism includes a pressing sleeve, a dust sleeve is embedded inside the pressing sleeve, a dust sleeve gland is disposed on an upper part of the dust sleeve, an oil scraping mechanism is disposed between the cylinder cap body and the pressing sleeve mechanism and includes a felt groove, a felt pad, and a pressure plate disposed on an upper part of the felt groove, and the pressure plate is fixedly connected to the felt groove; and a hydraulic loop of the hydraulic station is a hydraulic system and includes a power driving module and an oil circuit module, where the power driving module includes an oil tank and a power mechanism I and a power mechanism II connected to the oil tank, the oil tank is provided with a liquid level gauge, a liquid level controller, an air filter, and a temperature controller, each of the power mechanism I and the power mechanism II includes a plunger pump and a motor connected to the plunger pump through a coupler, a butterfly valve is disposed between the plunger pump and an oil outlet of the oil tank, a one-way valve is disposed in an oil outlet of the plunger pump and connected to a pressure gauge through a pressure measuring joint and a pressure measuring hose; and the oil circuit module includes an electro-hydraulic directional control valve I and an electro-hydraulic directional control valve II, each of the electro-hydraulic directional control valve I and the electro-hydraulic directional control valve II is connected to an energy accumulator through a high-pressure ball valve, an electromagnetic unloading valve is disposed between the electro-hydraulic directional control valve I and the power mechanism I, and the electro-hydraulic directional control valve II is connected to an overflow valve.

The steel wire rope fixing mechanism is fixedly mounted on a beam of the counterweight basket and includes a rocking plate, where rope baffle plates are disposed at two sides of the rocking plate and fixedly connected to the rocking plate through fixing members.

The rack includes four stand columns disposed vertically, an end cover plate is disposed on each of an upper end and a lower end of the stand columns, multiple cross braces are sequentially disposed from up to down between the four stand columns, two crossed diagonal braces are disposed between two cross braces located in the same plane, triangular brackets are disposed at two sides of the top of the stand columns and fixedly connected to the two sides of the top of the stand columns through hinges, a belaying cross arm structure and a guide plate component are disposed on the cross braces, the guide plate component includes a guide plate body and a tightening wheel component, the tightening wheel component is mounted on the guide plate body through a tightening wheel mounting plate, the belaying cross arm structure includes a cross arm, the cross arm is fixedly connected to the cross braces of the rack, a belaying wheel is mounted on the cross arm, and a regulating member is disposed between the belaying wheel and the cross arm.

The fixing member is a bolt.

A seal ring is disposed at a joint of the cylinder head and the cylinder shell.

A seal pad is disposed at a joint of the pressing sleeve mechanism and the cylinder cap body.

An air cooler is mounted on the oil tank and connected to the pressure gauge through the pressure measuring joint and the pressure measuring hose.

A shock absorber throat is disposed between the plunger pump and the butterfly value.

The regulating member is a pin.

Four tightening wheel components arranged diagonally are disposed on the guide plate body.

Advantageous Effect

In the derrick-type long-stroke hydraulic pumping unit of the present invention, the stand columns of the rack are disposed to be vertical, thereby facilitating production costs saving, and the triangular brackets are disposed at the two sides of the top of the stand columns and connected to the two sides of the top of the stand columns through the hinges, thereby improving firmness and being convenient for maintenance. The hydraulic control system of the hydraulic station of the present invention has high control sensitivity and high automation degree, thereby facilitating resource saving and work efficiency improvement. In the oil cylinder structure of the pumping unit of the present invention, the cylinder shell is designed to be a double layered cylinder shell, thereby prolonging a service life of the cylinder shell and reducing resource consumption. The multiple annual oil grooves are formed on the piston rod so that a closed path is formed for oil on the piston rod for cycle use, thereby saving resources and improving work efficiency. The belaying cross arm structure is disposed on the cross braces of the rack, so that the structure is simple, the resource consumption is low, and the operation is convenient, where the counterweight basket or the oil cylinder can be kept in the original position without falling during maintenance and the work can be resumed rapidly after the maintenance is finished, thereby saving work time. The steel wire rope fixing mechanism is disposed on the beam of the counterweight basket, thereby avoiding displacement of the steel wire rope caused by long-term work of the steel wire rope of the counterweight basket and further avoiding accidents. In the derrick-type long-stroke hydraulic pumping unit of the present invention, a telescoping mechanism for oil cylinder leaked oil recovery is not disposed in both the sucker rod side oil cylinder and the counterweight basket side oil cylinder, thereby efficiently saving resources.

The present invention has advantages of a reasonable structure, a long service life, high work efficiency, and resource saving.

BRIEF DESCRIPTION OF THE DRAWINGS

The present invention is further described below in detail in combination with the accompanying drawings and the detailed description of the present invention.

REFERENCE NUMBERS

1. rack; 2. counterweight basket; 3. sucker rod side oil cylinder; 4. counterweight basket-side oil cylinder; 5. hydraulic station; 6. oxbow component; 7. fixed pulley; 8. guard bar; 9. movable pulley; 10. steel wire rope fixing mechanism; 11. stand column; 12. end cover plate; 13. cross brace; 14. diagonal brace; 15. triangle bracket; 16. hinge; 17. belaying cross arm structure; 18. plate component; 19. plate body; 20. tightening wheel component; 21. tightening wheel mounting plate; 22. cross arm; 23. belaying wheel; 24. regulating member; 25. cylinder barrel; 26. cylinder head; 27. cylinder cap component; 28. cylinder shell; 29. piston; 30. piston rod; 31. annular oil gallery; 32. cylinder cap body; 33. fixing member; 34. inner barrel body; 35. outer barrel body; 36. annular plate; 37. drain port; 38. pressing sleeve; 39. dust sleeve; 40. dust sleeve gland; 41. felt groove; 42. felt pad; 43. pressure plate; 44. rocking plate; 45. rope baffle plate; 46. oil tank; 47. liquid level gauge; 48. air filter; 49. coupler; 50. plunger pump; 51. motor; 52. pressure measuring joint; 53. pressure gauge; 54. oil circuit module; 55. one-way valve; 56. electromagnetic unloading valve; 57. electro-hydraulic directional control valve I; 58. overflow valve; 59. electro-hydraulic directional control valve II; 60. power mechanism I; 61. high-pressure ball valve; 62. energy accumulator; 63. liquid level controller; 64. air cooler; 65. butterfly valve; 66. shock absorber throat; 67. power mechanism II; 68. pressure measuring hose; 69. temperature controller; 70. power driving module; 71. seal ring; 72. seal pad; 73. pressing sleeve mechanism; 74. oil scraping mechanism.

DETAILED DESCRIPTION OF THE INVENTION

Figure 1:
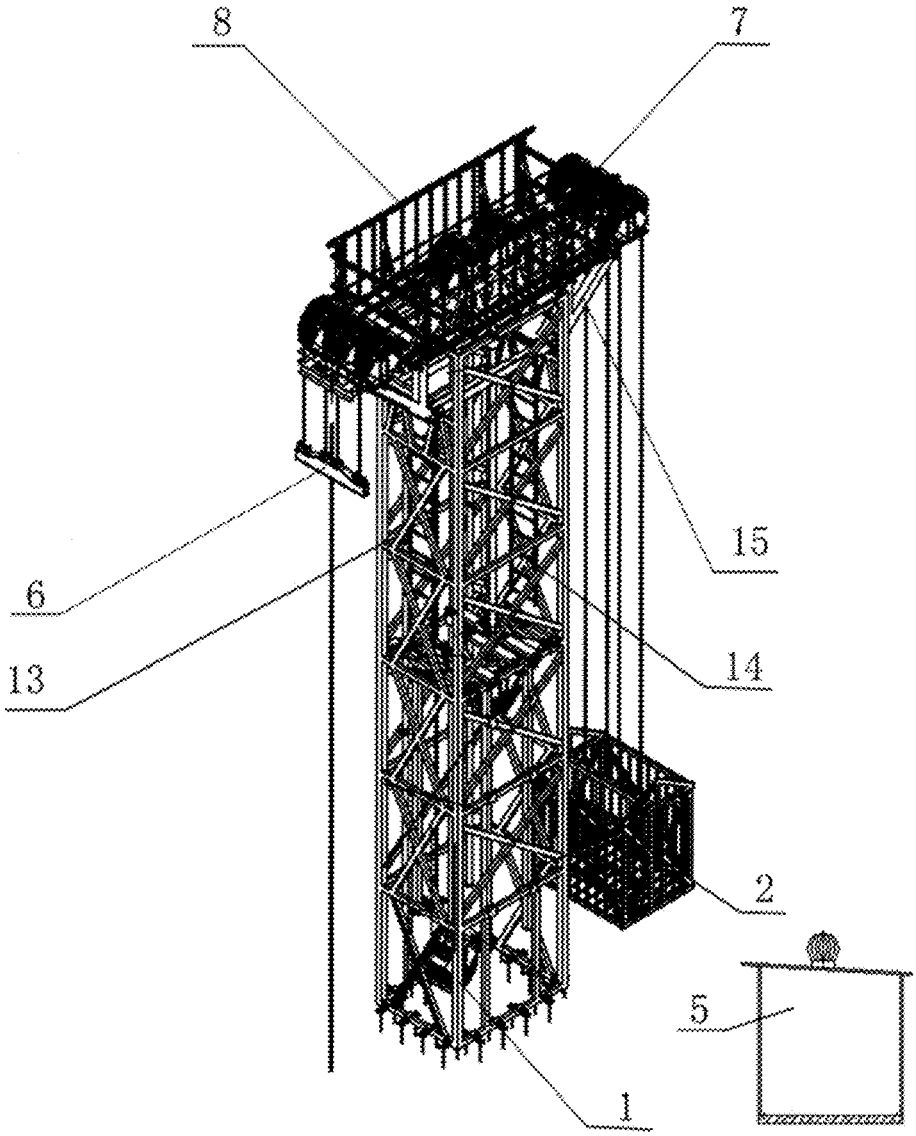
FIG. 1 is a schematic overall structural view of the present invention.
Figure 2:
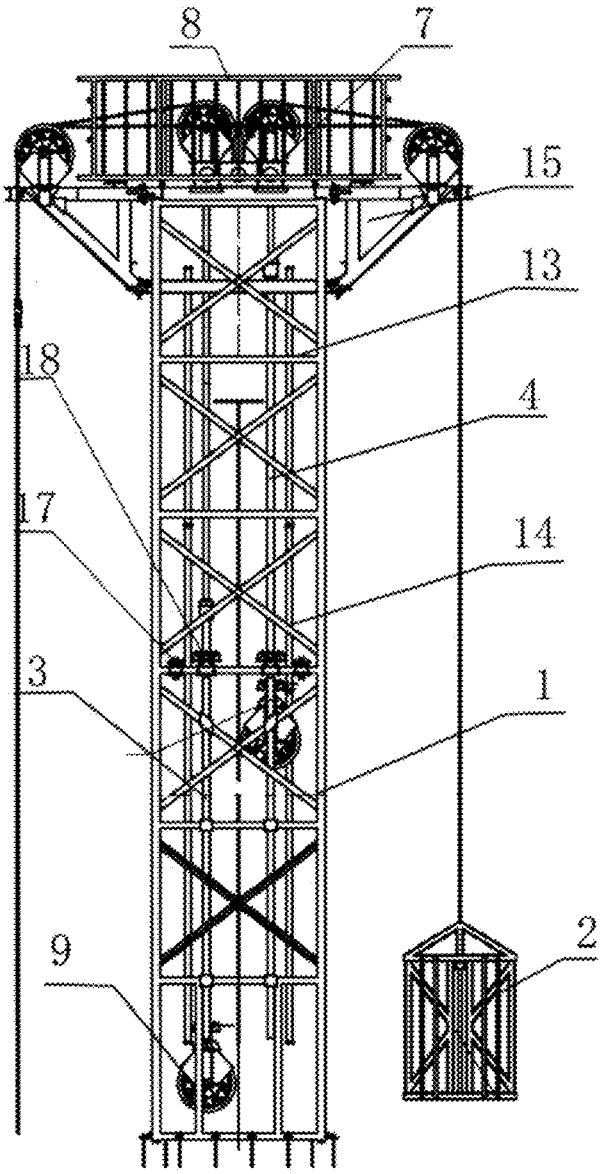
FIG. 2 is a front view of FIG. 1.
Figure 3:
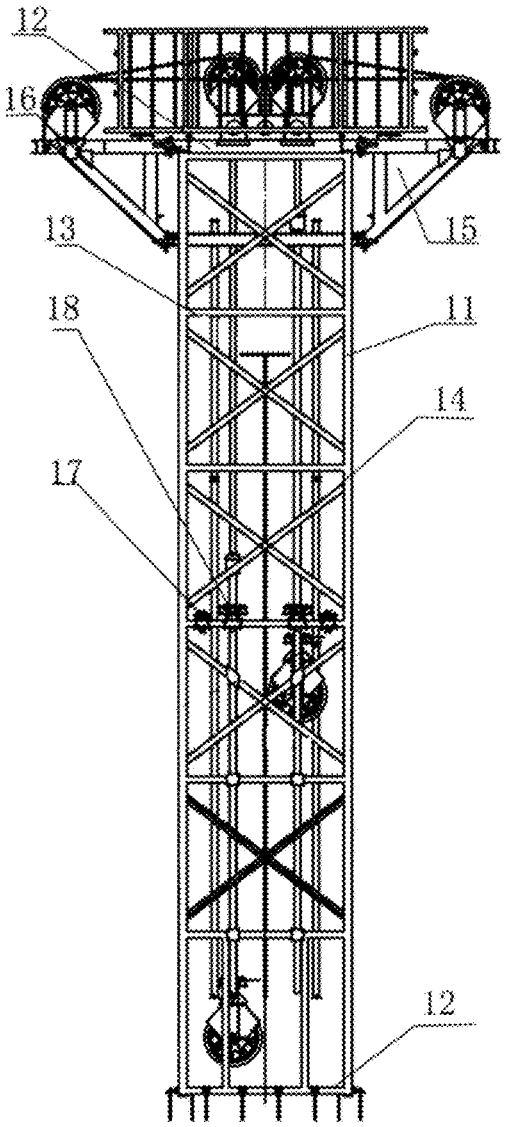
FIG. 3 is a schematic structural view of a rack.
Figure 4:
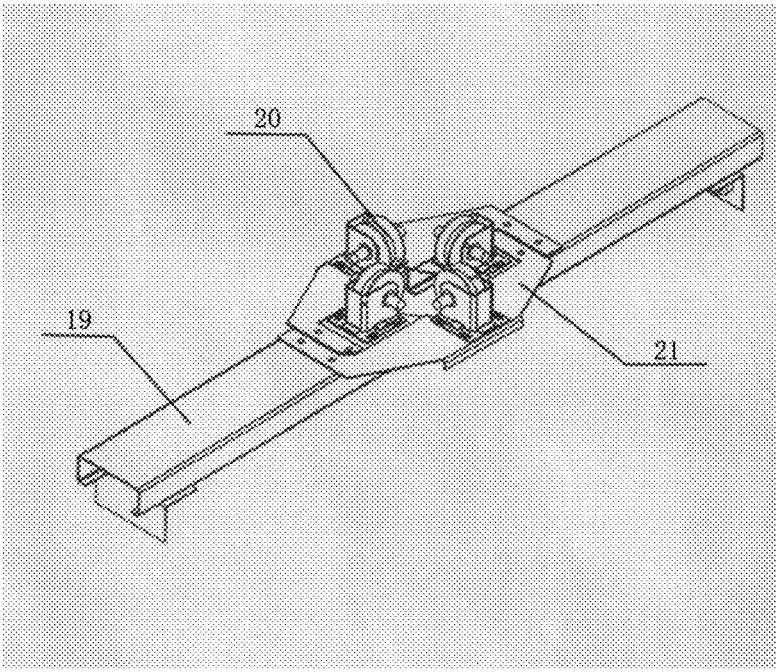
FIG. 4 is a schematic structural view of a guide plate.
Figure 5:
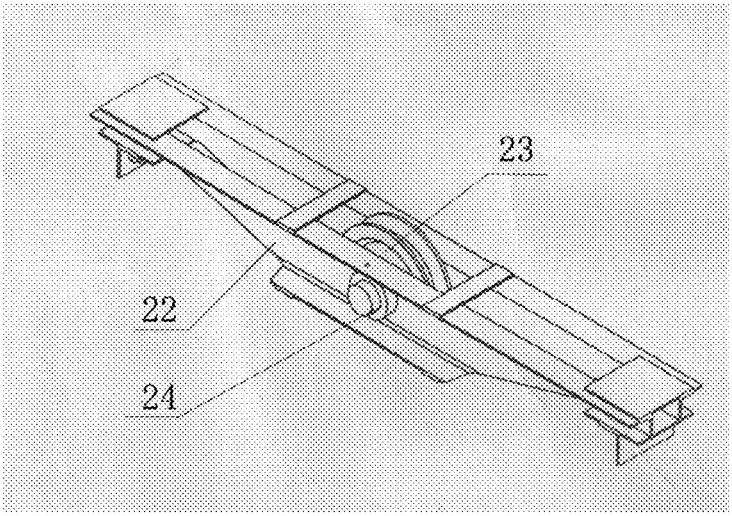
FIG. 5 is a schematic structural view of a belaying cross arm.
Figure 6:
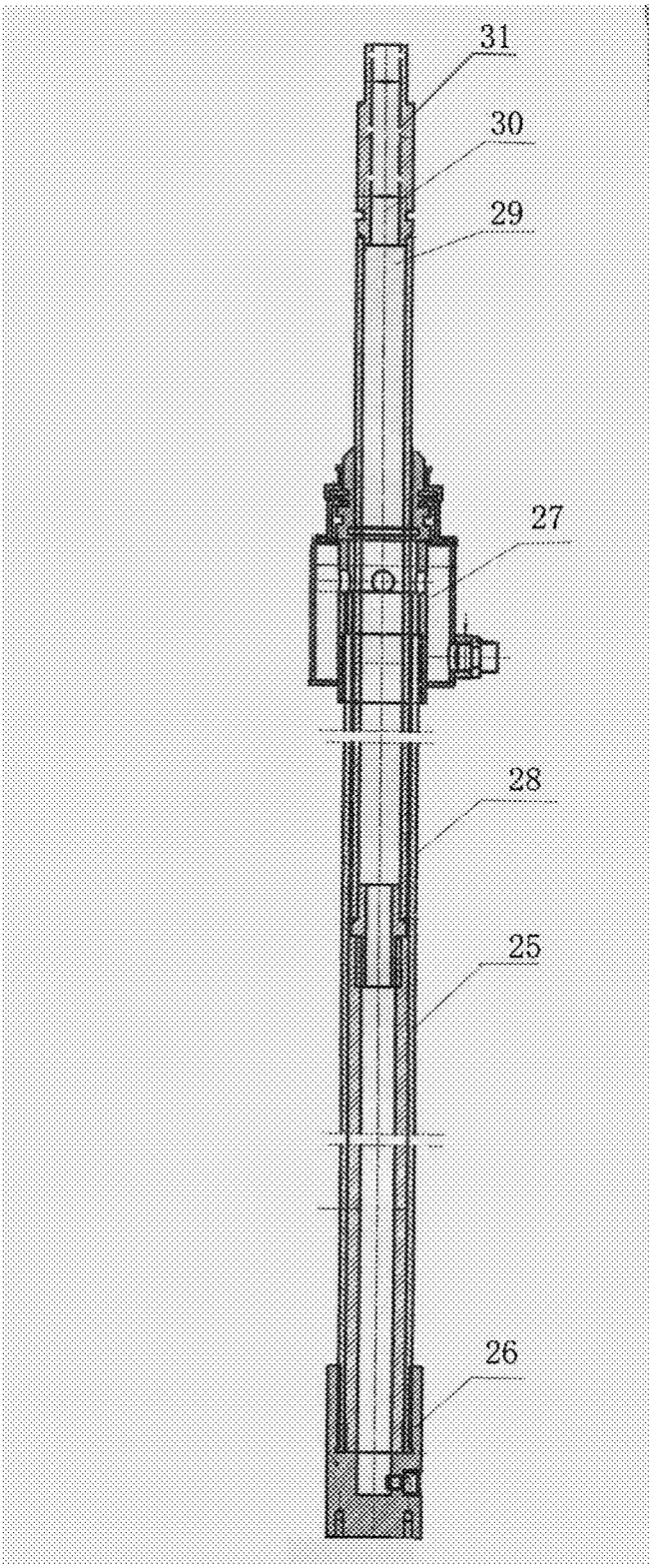
FIG. 6 is a schematic structural view of a hydraulic oil cylinder of a pumping unit.
Figure 7:
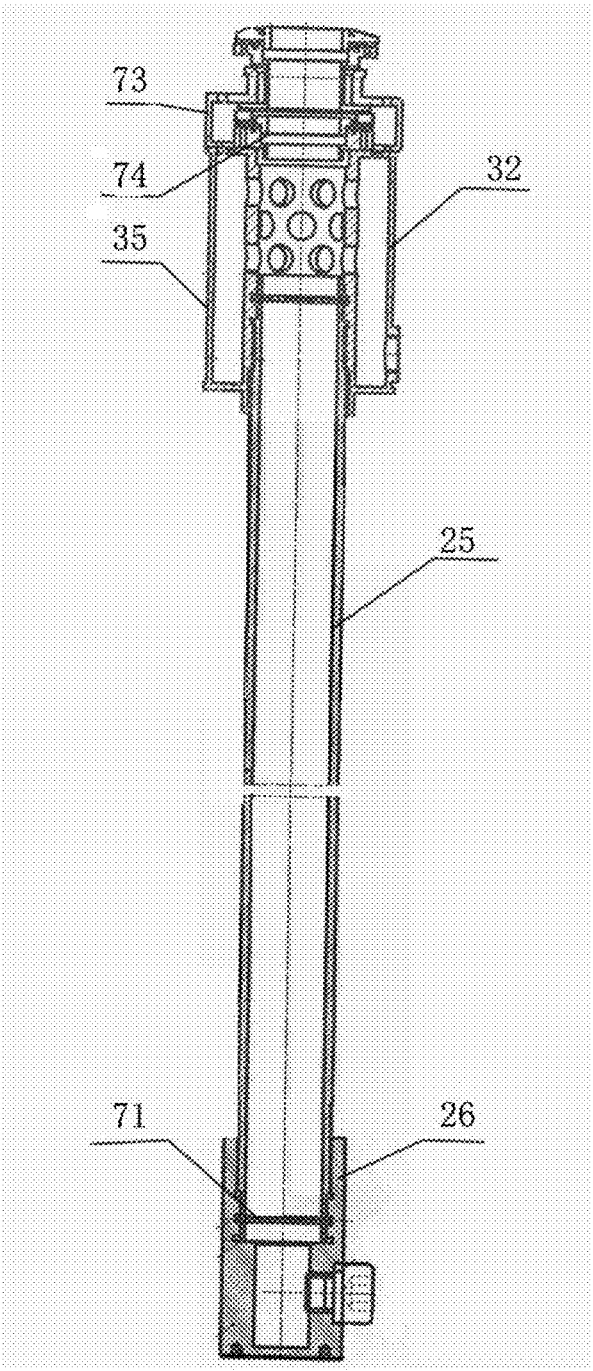
FIG. 7 is a schematic structural view of a cylinder barrel component.
Figure 8:
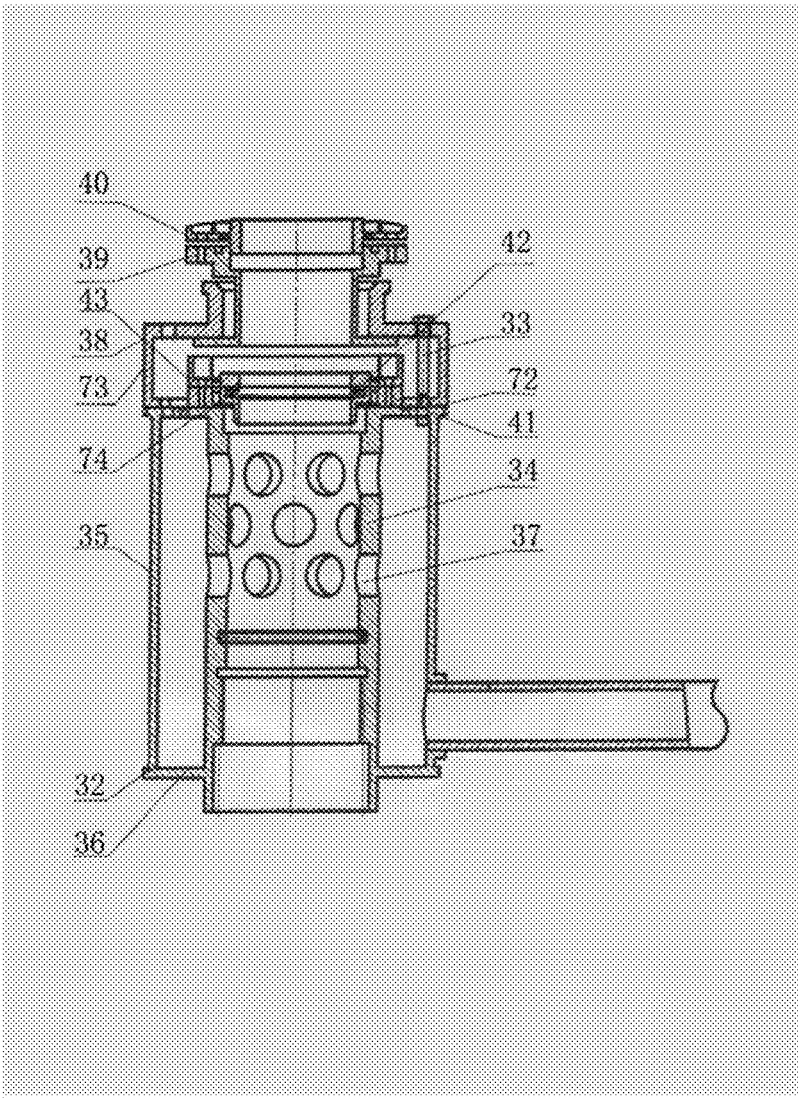
FIG. 8 is a schematic structural view of a cylinder cap component.
Figure 9:
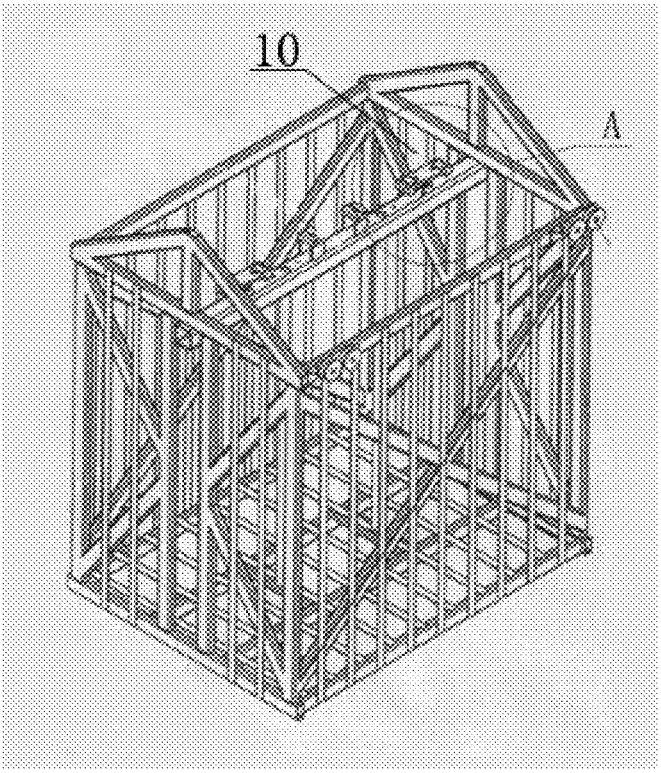
FIG. 9 is a schematic structural view of a steel wire rope fixing mechanism of a counterweight basket.
Figure 10:
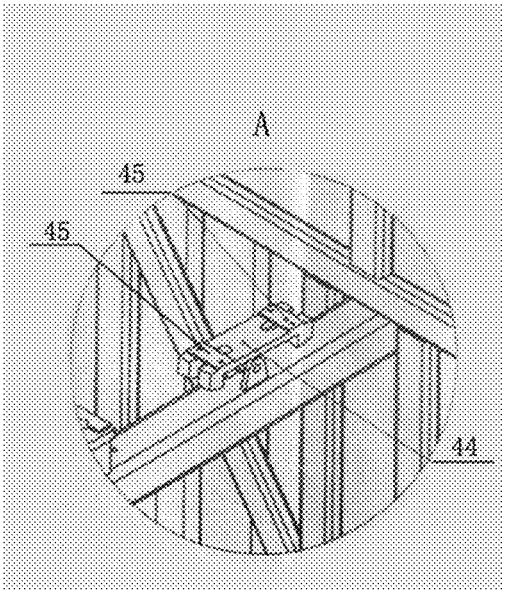
FIG. 10 is an enlarged view of the part A in FIG. 9.
Figure 11:
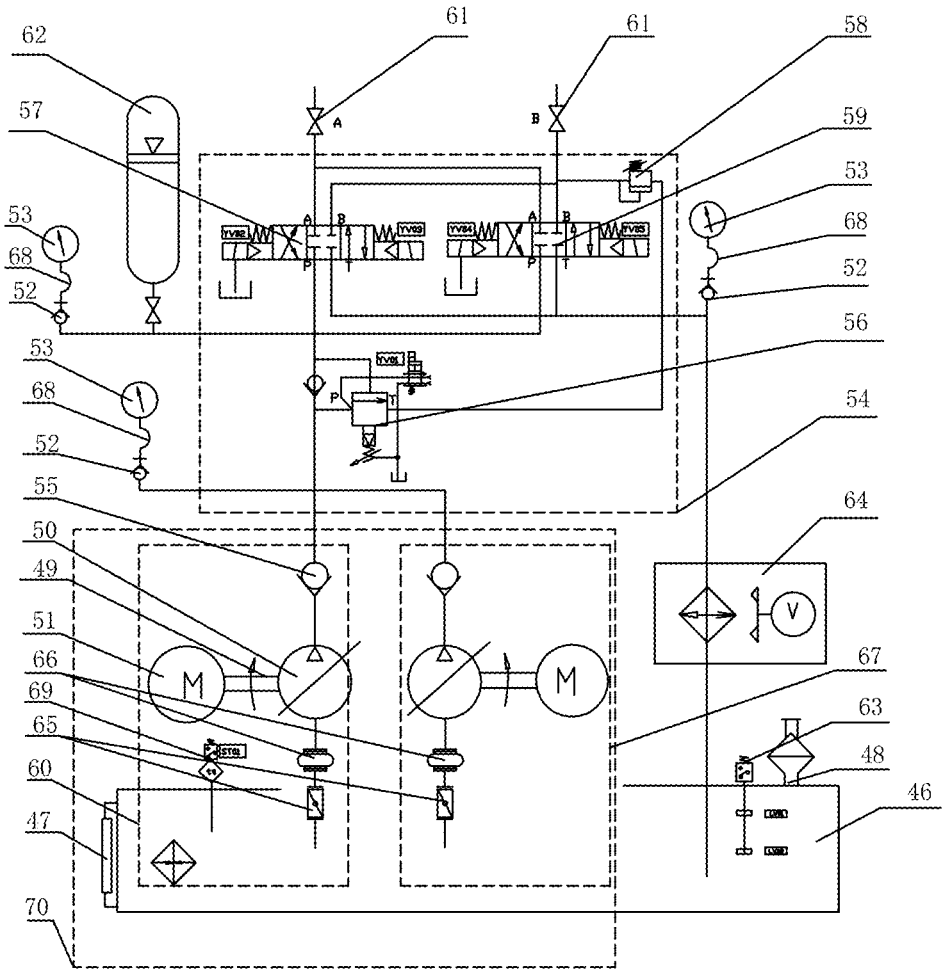
FIG. 11 is a schematic structural view of a hydraulic system of a hydraulic station.

As shown in FIG. 1 to FIG. 11, a derrick-type long-stroke hydraulic pumping unit of the present invention comprises a rack 1, a counterweight basket 2, a sucker rod side oil cylinder 3, a counterweight basket side oil cylinder 4, a hydraulic station 5, and an oxbow component 6 for fixing a steel wire rope, where six groups of fixed pulleys 7 and a guard bar 8 are disposed on the top of the rack 1, movable pulleys 9 are disposed at the bottom of each of the sucker rod side oil cylinder 3 and the counterweight basket side oil cylinder 4, a steel wire rope fixing mechanism 10 is disposed on the counterweight basket 2, the counterweight basket 2 is connected to the fixed pulleys 7, the movable pulleys 9 and the oxbow component 6 through the steel wire rope, each of the sucker rod side oil cylinder 3 and the counterweight basket side oil cylinder 4 includes a cylinder barrel component, the cylinder barrel component includes a cylinder barrel 25, a cylinder head 26 is disposed at one end of the cylinder barrel 25, a cylinder cap component 27 is disposed at the other end of the cylinder barrel 25, a cylinder shell 28 is disposed outside the cylinder barrel 25 and is a double layered cylinder shell, a seal ring 71 is disposed at a joint of the cylinder head 26 and the cylinder shell 28, a piston 29 and a piston rod 30 are disposed inside the cylinder barrel 25, multiple annual oil grooves 31 are formed on the piston rod 30, the cylinder cap component 27 includes a cylinder cap body 32, a pressing sleeve mechanism 73 is disposed on an upper part of the cylinder cap body 32 and is fixedly connected to the cylinder cap body 32 through a fixing member 33, the fixing member 33 is a bolt, and a seal pad 72 is disposed at a joint of the pressing sleeve mechanism 73 and the cylinder cap body 32. The cylinder cap body 32 includes an inner barrel body 34 and an outer barrel body 35, two ends of the inner barrel body 34 and the outer barrel body 35 are connected through an annular plate 36, a drain port 37 is disposed on the inner barrel body 34, the pressing sleeve mechanism includes a pressing sleeve 38, a dust sleeve 39 is embedded inside the pressing sleeve 38, a dust sleeve gland 40 is disposed on an upper part of the dust sleeve 39, an oil scraping mechanism 74 is disposed between the cylinder cap body 32 and the pressing sleeve mechanism and includes a felt groove 41, a felt pad 42, and a pressure plate 43 disposed on an upper part of the felt groove 41, and the pressure plate 43 is fixedly connected to the felt groove 41; a hydraulic loop of the hydraulic station 5 is a hydraulic system which includes a power driving module 70 and an oil circuit module 54, where the power driving module 70 includes an oil tank 46 and a power mechanism I 60 and a power mechanism II 67 connected to the oil tank 46, the oil tank 46 is provided with a liquid level gauge 47, a liquid level controller 63, an air filter 48, and a temperature controller 69, each of the power mechanism I 60 and the power mechanism II 67 includes a plunger pump 50 and a motor 51 connected to the plunger pump 50 through a coupler 49, a butterfly valve 65 is disposed between the plunger pump 50 and an oil outlet of the oil tank 46, a one-way valve 55 is disposed in an oil outlet of the plunger pump 50 and connected to a pressure gauge 53 through a pressure measuring joint 52 and a pressure measuring hose 68, the oil circuit module 54 includes an electro-hydraulic directional control valve I 57 and an electro-hydraulic directional control valve II 59, each of the electro-hydraulic directional control valve I 57 and the electro-hydraulic directional control valve II 59 is connected to an energy accumulator 62 through a high-pressure ball valve 61, an electromagnetic unloading valve 56 is disposed between the electro-hydraulic directional control valve I 57 and the power mechanism I 60, and the electro-hydraulic directional control valve II 59 is connected to an overflow valve 58. An air cooler 64 is mounted on the oil tank 46 and connected to the pressure gauge 53 through the pressure measuring joint 52 and the pressure measuring hose 68. A shock absorber throat 66 is disposed between the plunger pump 50 and the butterfly value 65. The steel wire rope fixing mechanism 10 is fixedly mounted on a beam of the counterweight basket and includes a rocking plate 44, rope baffle plates 45 are disposed at two sides of the rocking plate 44 and fixedly connected to the rocking plate 44 through fixing members, the rack 1 includes four stand columns 11 disposed vertically, an end cover plate 12 is disposed on each of an upper end and a lower end of the stand columns 11, multiple cross braces 13 are sequentially disposed from up to down between the four stand columns 11, two crossed diagonal braces 14 are disposed between two cross braces 13 located in the same plane, triangular brackets 15 are disposed at two sides of the top of the stand columns 11 and fixedly connected to the two sides of the top of the stand columns 11 through hinges 16, a belaying cross arm structure 17 and a guide plate component 18 are disposed on the cross braces 13, the guide plate component 18 includes a guide plate body 19 and a tightening wheel component 20, the tightening wheel component 20 is mounted on the guide plate body 19 through a tightening wheel mounting plate 21, and four tightening wheel components 20 arranged diagonally are disposed on the guide plate body 19. The belaying cross arm structure 17 includes a cross arm 22, the cross arm 22 is fixedly connected to the cross braces 13 of the rack, a belaying wheel 23 is mounted on the cross arm 22, and a regulating member 24 is disposed between the belaying wheel 23 and the cross arm 22 and is a pin.

What is claimed is:

1. A derrick-type long-stroke hydraulic pumping unit, comprising: a rack, a counterweight basket, a sucker rod side oil cylinder, a counterweight basket side oil cylinder, a hydraulic station, and an oxbow component for fixing a steel wire rope, wherein six groups of fixed pulleys and a guard bar are disposed on the top of the rack, movable pulleys are disposed at the bottom of each of the sucker rod side oil cylinder and the counterweight basket side oil cylinder, a steel wire rope fixing mechanism is disposed on the counterweight basket, and the counterweight basket is connected to the fixed pulleys, the movable pulleys and the oxbow component through the steel wire rope, wherein each of the sucker rod side oil cylinder and the counterweight basket side oil cylinder includes a cylinder barrel component, the cylinder barrel component includes a cylinder barrel, a cylinder head is disposed at one end of the cylinder barrel, a cylinder cap component is disposed at the other end of the cylinder barrel, a cylinder shell is disposed outside the cylinder barrel and is a double layered cylinder shell, a piston and a piston rod are disposed inside the cylinder barrel, multiple annual oil grooves are formed on the piston rod the cylinder cap component includes a cylinder cap body, a pressing sleeve mechanism is disposed on an upper part of the cylinder cap body and is fixedly connected to the cylinder cap body through a fixing member, the cylinder cap body includes an inner barrel body and an outer barrel body, two ends of the inner barrel body and the outer barrel body are connected through an annular plate, a drain port is disposed on the inner barrel body, the pressing sleeve mechanism includes a pressing sleeve, a dust sleeve is embedded inside the pressing sleeve, a dust sleeve gland is disposed on an upper part of the dust sleeve, an oil scraping mechanism is disposed between the cylinder cap body and the pressing sleeve mechanism and includes a felt groove, a felt pad, and a pressure plate disposed on an upper part of the felt groove, and the pressure plate is fixedly connected to the felt groove; and a hydraulic loop of the hydraulic station is a hydraulic system which includes a power driving module and an oil circuit module, wherein the power driving module includes an oil tank and a power mechanism I and a power mechanism II connected to the oil tank, the oil tank is provided with a liquid level gauge, a liquid level controller, an air filter, and a temperature controller, each of the power mechanism I and the power mechanism II includes a plunger pump and a motor connected to the plunger pump through a coupler, a butterfly valve is disposed between the plunger pump and an oil outlet of the oil tank, a one-way valve is disposed in an oil outlet of the plunger pump and connected to a pressure gauge through a pressure measuring joint and a pressure measuring hose; and the oil circuit module includes an electro-hydraulic directional control valve I and an electro-hydraulic directional control valve II, each of the electro-hydraulic directional control valve I and the electro-hydraulic directional control valve II is connected to an energy accumulator through a high-pressure ball valve, an electromagnetic unloading valve is disposed between the electro-hydraulic directional control valve I and the power mechanism I, and the electro-hydraulic directional control valve II is connected to an overflow valve, wherein the rack includes four stand columns disposed vertically, an end cover plate is disposed on each of an upper end and a lower end of the stand columns, multiple cross braces are sequentially disposed from up to down between the four stand columns, two crossed diagonal braces are disposed between two cross braces located in the same plane, triangular brackets are disposed at two sides of the top of the stand columns and fixedly connected to the two sides of the top of the stand columns through hinges, a belaying cross arm structure and a guide plate component are disposed on the cross braces, the guide plate component includes a guide plate body and a tightening wheel component, the tightening wheel component is mounted on the guide plate body through a tightening wheel mounting plate, the belaying cross arm structure includes a cross arm, the cross arm is fixedly connected to the cross braces of the rack, a belaying wheel is mounted, on the cross arm, and a regulating member is disposed between the belaying wheel and the cross arm.

2. The derrick-type long-stroke hydraulic pumping unit of claim 1, wherein the fixing member is a bolt.

3. The derrick-type long-stroke hydraulic pumping unit of claim 1, wherein a seal ring is disposed at a joint of the cylinder head and the cylinder shell.

4. The derrick-type long-stroke hydraulic pumping unit of claim 1, wherein a seal pad is disposed at a joint of the pressing sleeve mechanism and the cylinder cap body.

5. The derrick-type long-stroke hydraulic pumping unit of claim 1, wherein an air cooler is mounted on the oil tank and connected to the pressure gauge through the pressure measuring joint and the pressure measuring hose.

6. The derrick-type long-stroke hydraulic pumping unit of claim 1, wherein a shock absorber throat is disposed between the plunger pump and the butterfly valve.

7. The derrick-type long-stroke hydraulic pumping unit of claim 1, wherein the regulating member is a pin.

8. The derrick-type long-stroke hydraulic pumping unit of claim 1, wherein four tightening wheel components arranged diagonally are disposed on the guide plate body.

9. The derrick-type long-stroke hydraulic pumping unit of claim 1, wherein the steel wire rope fixing mechanism is fixedly mounted on a beam of the counterweight basket and comprises a rocking plate, wherein rope baffle plates are disposed at two sides of the rocking plate and fixedly connected to the rocking plate through fixing members.

* * * * *